US005129965A

United States Patent [19]

Kobayashi et al.

[11] Patent Number: 5,129,965

[45] Date of Patent: Jul. 14, 1992

[54] METHOD OF PRODUCING GRAIN ORIENTED SILICON STEEL SHEETS EACH HAVING A LOW WATT LOSS AND A MIRROR SURFACE

[75] Inventors: Hisashi Kobayashi; Yoshiyuki Ushigami; Hiroyasu Fujii, all of Kitakyushu, Japan

[73] Assignee: Nippon Steel Corporation, Tokyo, Japan

[21] Appl. No.: 732,076

[22] Filed: Jul. 18, 1991

[30] Foreign Application Priority Data

Jul. 20, 1990 [JP] Japan ..... 2-190441
Sep. 21, 1990 [JP] Japan ..... 2-250087
Dec. 28, 1990 [JP] Japan ..... 2-409378

[51] Int. Cl.[5] ..... C21D 8/12; C25F 3/24

[52] U.S. Cl. ..... 148/113; 148/112; 148/122; 148/111; 148/254; 148/537

[58] Field of Search ..... 148/111, 112, 113, 122, 148/16.7, 16.6, 20.3, 12 A

[56] References Cited

U.S. PATENT DOCUMENTS 3,856,568 12/1974 Tanaka et al. ..... 148/12 A
4,713,123 12/1987 Inokuti et al. ..... 148/113

FOREIGN PATENT DOCUMENTS 58-086405 5/1983 Japan .
0131976 7/1985 Japan ..... 148/113
62-008617 1/1987 Japan .
0031050 7/1987 Japan ..... 148/113
63-006611 2/1988 Japan .
63-044804 9/1988 Japan .
1-083620 3/1989 Japan .

*Primary Examiner*—Melvyn J. Andrews
*Assistant Examiner*—Sikyin Ip
*Attorney, Agent, or Firm*—Kenyon & Kenyon

[57] ABSTRACT

A method of producing grain oriented silicon steel sheets each having a low watt loss, at an inexpensive cost and a high operational efficiency, wherein surfaces of each silicon steel sheet are given a mirror surface is disclosed. After completion of a finish annealing, forsterite films on the surface of each grain oriented silicon steel sheet are removed therefrom, and thereafter, the silicon steel sheet is annealed within the temperature range of 1000° C. or higher in an atmosphere composed of a mixture gas comprising 20 to 80% by volume of hydrogen gas and 0 to 80% by volume of an inert gas, whereby surfaces of the silicon steel sheet are given a mirror surface. Subsequently, tensile stress additive films are formed on the surfaces of the silicon steel sheet, and consequently, the resultant silicon steel sheet exhibits a remarkably reduced watt loss.

11 Claims, 3 Drawing Sheets

METHOD OF PRODUCING GRAIN ORIENTED SILICON STEEL SHEETS EACH HAVING A LOW WATT LOSS AND A MIRROR SURFACE

BACKGROUND OF THE INVENTION

1. Field of the Invention

The present invention relates to a method of producing grain oriented silicon steel sheets each having a very low watt loss. More particularly, the present invention relates to an improvement of the method of producing grain oriented silicon steel sheets each having a very low watt loss, wherein a watt loss property of each silicon steel sheet can be remarkably improved by a smooth and flat finishing of surfaces of each silicon steel sheet at a high operational efficiency.

2. Description of the Related Art

As is well known, many grain oriented silicon steel sheets are practically used as a raw material for magnetic cores incorporated in various kinds of electric devices, apparatus or the like, and in order to reduce energy loss, there is a demand by users for grain oriented silicon steel sheets each having a low watt loss. In this connection, a means for reducing a watt loss of each grain oriented silicon steel sheet is disclosed in an official gazette of, e.g., Japanese Unexamined Patent Publication Patent (Kokai) No. 58-26405, which is concerned with a method of reducing a value indicating a watt loss wherein a laser light beam is irradiated on one surface of a grain oriented silicon steel sheet after a completion of a finish annealing operation to induce a local strain on the silicon steel sheet, to thus cause a magnetic domain subdivisional treatment to be conducted. In addition, magnetic domain subdivisional treating means which ensure that a magnetic domain subdivisional treatment effect does not disappear, even when grain oriented silicon steel sheets are subjected to strain-remove annealing (stress-relief annealing) after being worked to a shape corresponding a core, is disclosed in an official gazette of, e.g., Japanese Unexmained Patent Publication (Kokai) No. 62-8617. It has been found that a watt loss of each grain oriented silicon steel sheet can be substantially reduced by employing any one of the aforementioned technical means. When a value indicating a watt loss of each silicon steel sheet must be further reduced, glassy films remaining on the surface of the silicon steel sheet after a completion of a finish annealing operation must be removed therefrom, and moreover, a roughness of the surface of a ferrous substrate of the silicon steel sheet effective for inhibiting a displacement of a magnetic domain on the surface of the silicon steel sheet must be removed therefrom. To this end, the surface of a ferrous substrate of each silicon steel sheet must be finished to a mirror surface after the completion of the finish annealing operation.

Additionally, a method of finishing the surface of a ferrous substrate of each steel sheet with a mirror surface, after the completion of a finish annealing operation, is disclosed in an official gazette of Japanese Unexamined Publication Patent (Kokai) No. 64-83620, which is concerned with a method of bringing the foregoing surface to a mirror surface by employing a chemical polishing process or a mechanical polishing process.

A chemical polishing process, an electrolytic polishing process and a mechanical polishing process conducted with the aid of a grinding wheel, a brush or similar means are used as a means for finishing the surface of a steel sheet to a mirror finish. The chemical polishing process and the electrolytic polishing process are preferably employed as a means for preparing a small number of test pieces, and cannot be employed as means for finishing the surface of a strip of metallic material to a mirror surface, e.g., a strip of silicon steel sheet produced on an industrial basis on a mass production line, because complicated operations for controlling the concentrations of various kinds of liquid chemicals and temperatures at various locations must be performed, and moreover, an expensive apparatus for preventing an occurrence of public pollution must be installed. Where the mechanical polishing process is employed, it is very difficult to uniformly finish a mirror surface of a metallic material having a large surface area, e.g., a strip of steel sheet produced on an industrial basis on a mass production line.

SUMMARY OF THE INVENTION

The present invention has been made with the foregoing background in mind.

An object of the present invention is to provide a method of producing grain oriented silicon steel plates each having a low watt loss, wherein a means for performing a mirror surface finishing operation for each strip of silicon steel sheet produced on an industrial basis on a mass production line is arranged, for practicing the method of the present invention.

To solve the aforementioned problems inherent to the prior art, the inventors conducted a variety of examinations and research and development work, and accordingly, found from the results derived from this work that a mirror surface can be easily obtained by heating a silicon steel sheet within the temperature range of 1000° C. or higher in an atmosphere composed of a mixture gas comprising a hydrogen gas of 20% or more by volume and the residue of an inert gas, while a ferrous substrate of the silicon steel sheet is exposed to the outside. Where the foregoing heating treatment is conducted for a single silicon steel sheet, there is no need to employ a spacer, but where the foregoing heat treatment is conducted for a strip coil or a plurality of silicon steel sheets placed one above another, to form a laminated structure, one or both of alumina powder and magnesia powder must be spread over an intermediate region between adjacent silicon steel sheets, because a strip surface seizure malfunction occurs therebetween. Additionally, another silicon steel sheet having forsterite films deposited thereon may be interposed therebetween as a spacer. In addition, it has been found that mirror surfaces can be easily obtained when two superimposed strip coils are annealed in the aforementioned atmosphere, wherein one of two strips is a strip of silicon steel sheet having forsterite films deposited thereon and the other is a strip of silicon steel sheet, the ferrous substrate of which is exposed to the outside after the completion of a finish annealing operation. In this case, the spacer is not thermally secured to the silicon steel sheets after the completion of the annealing operation, but even when the spacer is thermally secured thereto, it can be easily removed therefrom.

It should be noted that the mirror surfacing treatment effect is remarkable when the silicon steel sheets are annealed in an atmosphere containing a hydrogen gas of 50% or more by volume.

An argon gas and a nitrogen gas are practically used as an inert gas. Where a nitrogen gas of 50% and more by volume is used for the atmosphere employed in the annealing operation, preferably a cooling operation is started within the temperature range lower than 1000° C., in an atmosphere composed of a hydrogen gas of 100%.

Specifically, a characterizing feature of the present invention is that, after the completion of a finish annealing operation, an oxide layer on the surface of each grain oriented silicon steel sheet or strip is removed therefrom to allow a ferrous substrate of the silicon steel sheet or strip to be exposed to the outside, one or both of alumina powder and magnesia powder are spread over an intermediate region between adjacent silicon steel sheets or strips, or another silicon steel sheet or strip having forsterite films deposited thereon is interposed therebetween, these silicon steel sheets or strips are annealed or heated within the temperature range of 1000° C. or higher in an atmosphere composed of a mixture gas comprising a hydrogen gas of 20 to 100% by volume and an inert gas of 0 to 80% by volume, to allow the surfaces of the silicon steel sheets or strips to be subjected to a mirror surfacing treatment, (subsequently, a cooling operation is performed within the temperature range lower than 1000° C. in an atmosphere composed of a hydrogen gas of 100%, if necessary), and a tensile stress additive film is finally formed on the surface of each silicon steel sheet or strip.

Of course, it is obvious to any expert in the art that a magnetic domain controlling technique as disclosed in official gazettes of Japanese Examined Publication Patent (Kokoku) No. 63-44804 and Japanese Examined Publication Patent (Kokoku) No. 63-6611 is applicable to the resultant product of grain oriented silicon steel sheet produced in the above-described manner, wherein the foregoing controlling technique is such that a magnetic domain subdivisional treatment effect does not disappear when a strain-removing annealing operation is performed after grain oriented silicon steel sheets are worked to a shape corresponding to a core.

Other objects, features and advantages of the present invention will become apparent from the following description, which is given in conjunction with the accompanying drawings.

BRIEF DESCRIPTION OF THE DRAWINGS

The present invention is illustrated in the following drawings in which.

DESCRIPTION OF THE PREFERRED EMBODIMENT

Figure 1:
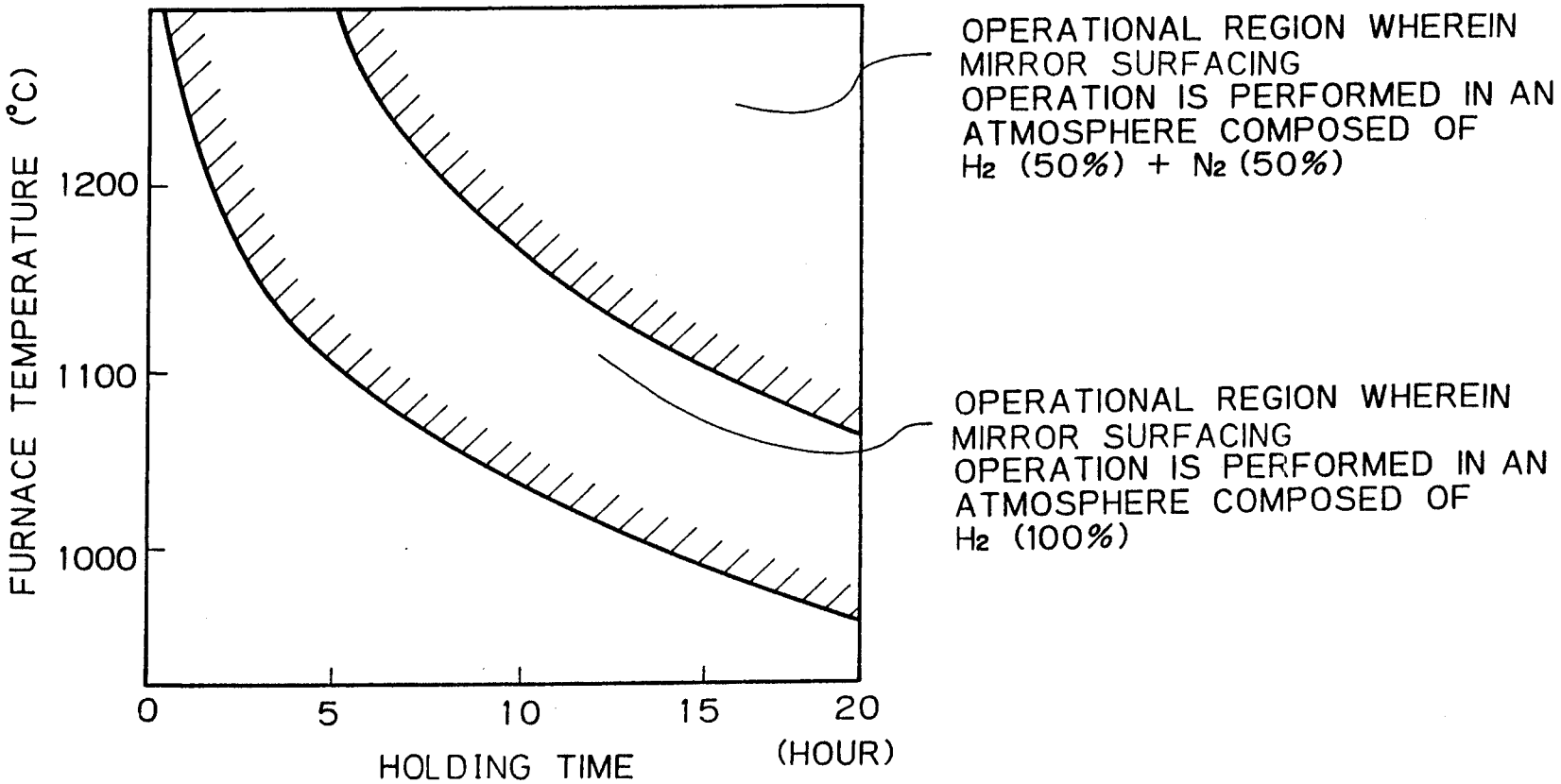
FIG. 1 is a diagram which illustrates a relationship between a time and a heat treatment temperature, with volumetric contents of a hydrogen gas and a nitrogen gas used as a parameter, when surfaces of a grain oriented silicon steel sheet are subjected to a mirror surfacing treatment after a completion of a finish annealing operation.

The present invention is described in detail hereinafter with reference to the accompanying drawings, which illustrate a preferred embodiment of the present invention.

According to the embodiment of the present invention, a method of producing grain oriented electrical steel sheets each having a low watt loss is practiced in the following manner.

First, a steel slab containing 4% or less by weight of silicon is heated to produce a hot rolled plate by a hot rolling operation. If necessary, the hot rolled plate is annealed after completion of the hot rolling operation. Subsequently, the hot rolled plate is cold rolled twice to produce a cold rolled sheet having a predetermined final thickness, under the condition that an intermediate annealing is once or twice performed during the cold rolling. Thereafter, the cold rolled sheet is decarburization annealed and then coated with a separating agent for removing residual film on the surfaces of each cold rolled sheet derived from the decarburization annealing. The resultant cold rolled sheet is wound about a shaft or core to produce a strip coil, and subsequently, the strip coil is finish annealed at an elevated temperature for a long time, to grow secondary recrystallized crystalline grains each having (110) and (001) orientations. After completion of the finish annealing, forsterite films on the silicon steel sheet are chemically or mechanically removed therefrom, so that the resultant silicon steel sheet has a surface roughness of less than three microns. Thereafter, the strip coil is annealed at a temperature higher than 1000° C. in an atmosphere comprising a mixture gas composed of a hydrogen gas of 20% or more by volume and an inert gas (inclusive of a case where the mixture gas is composed of 100% hydrogen gas).

It is well known that iron atoms are vaporized from the surface of a silicon steel plate, and the iron atoms are then displaced therefrom by heating the steel plate, the ferrous substrate of which is exposed to the outside, in a mixture gas containing a reduction gas, whereby a flat surface not inducing a magnetic pinning can be obtained, for the steel plate.

Preferably, a gas to be mixed with a hydrogen gas is an inert gas such as an argon gas. The use of a mixture gas composed of a hydrogen gas and a nitrogen gas is most inexpensive on an industrial basis.

Where a gas to be mixed with a hydrogen gas is argon, preferably the mixture gas contains a 20% or more by volume of hydrogen gas, since the mixture gas little reacts with surfaces of a silicon steel plate.

As the content of a hydrogen gas by volume in an atmosphere is increased, a mirror surfacing treatment effect of the silicon steel sheet is correspondingly increased. When the atmosphere is composed of a mixture gas containing an about 20% by volume of hydrogen gas the mirror surfacing treatment effect appears. Especially, when the atmosphere is composed of a mixture gas containing a 50% or more by volume of hydrogen gas, the mirror surfacing treatment effect is remarkable. When the content of a hydrogen gas is made less than 20% by volume, the surface of a silicon steel sheet is oxidized, and thus a metallic brightness of the surface of the silicon steel plate is degraded. In addition, the magnetic properties of the silicon steel sheet become poor.

Where a gas to be mixed with a hydrogen gas is a nitrogen gas, a reaction of the nitrogen gas with the surface of a silicon steel sheet during a heating or cooling operation takes place to some extent when the content of a nitrogen gas to be mixed with a hydrogen gas is set to the range of 0 to 50% by volume. For this reason, the content of a hydrogen gas employed for the chemical reduction is set to 50% or more by volume, to ensure that a mirror finished surface is obtained with the silicon steel sheet. On the contrary, when the content of a nitrogen gas to be mixed with a hydrogen gas is set to 50% or more by volume, the nitrogen gas solid-dissolved in a ferrous substrate of the silicon steel sheet within the temperature range of 1000° C. or higher is precipitated in the form of a silicon nitride during a cooling of the silicon steel sheet, and thus a magnetic domain on the silicon steel sheet is subjected to magnetic pinning. For this reason, the atmosphere employed within the temperature range lower than 1000° C. is composed of a 100% by volume of hydrogen gas. In addition, a carbon monoxide gas serving as a reduction gas may be mixed with a hydrogen gas. In this case, preferably the mixed reduction gas having a content of 50 to 100% by volume is contained in the atmosphere. Additionally, the content of a hydrogen gas by volume must be set to 20% or more.

When an annealing temperature is set higher, a mirror finished surface can be obtained within a shorter period of time. When the annealing temperature is set to 1000° C. or higher, iron atoms on the surface of a silicon steel sheet can be effectively vaporized or displaced therefrom. For this reason, a lower limit of the annealing temperature is set to 1000° C. If the annealing temperature is made lower than 1000° C., a mirror surfacing treatment effect is degraded. Therefore, such an annealing temperature as mentioned above is not acceptable from the viewpoint of an industrial process.

FIG. 1 is a diagram which illustrates a relationship between a time and an annealing temperature for forming mirror surfaces on a silicon steel sheet in an atmosphere composed of a 100% hydrogen gas as well as an atmosphere composed of a mixture gas comprising 50% hydrogen gas and 50% nitrogen gas, wherein the mirror surfaces have an average surface roughness of 0.3 micron or less and do not include any oxide film which may induce magnetic pinning.

Figure 2:
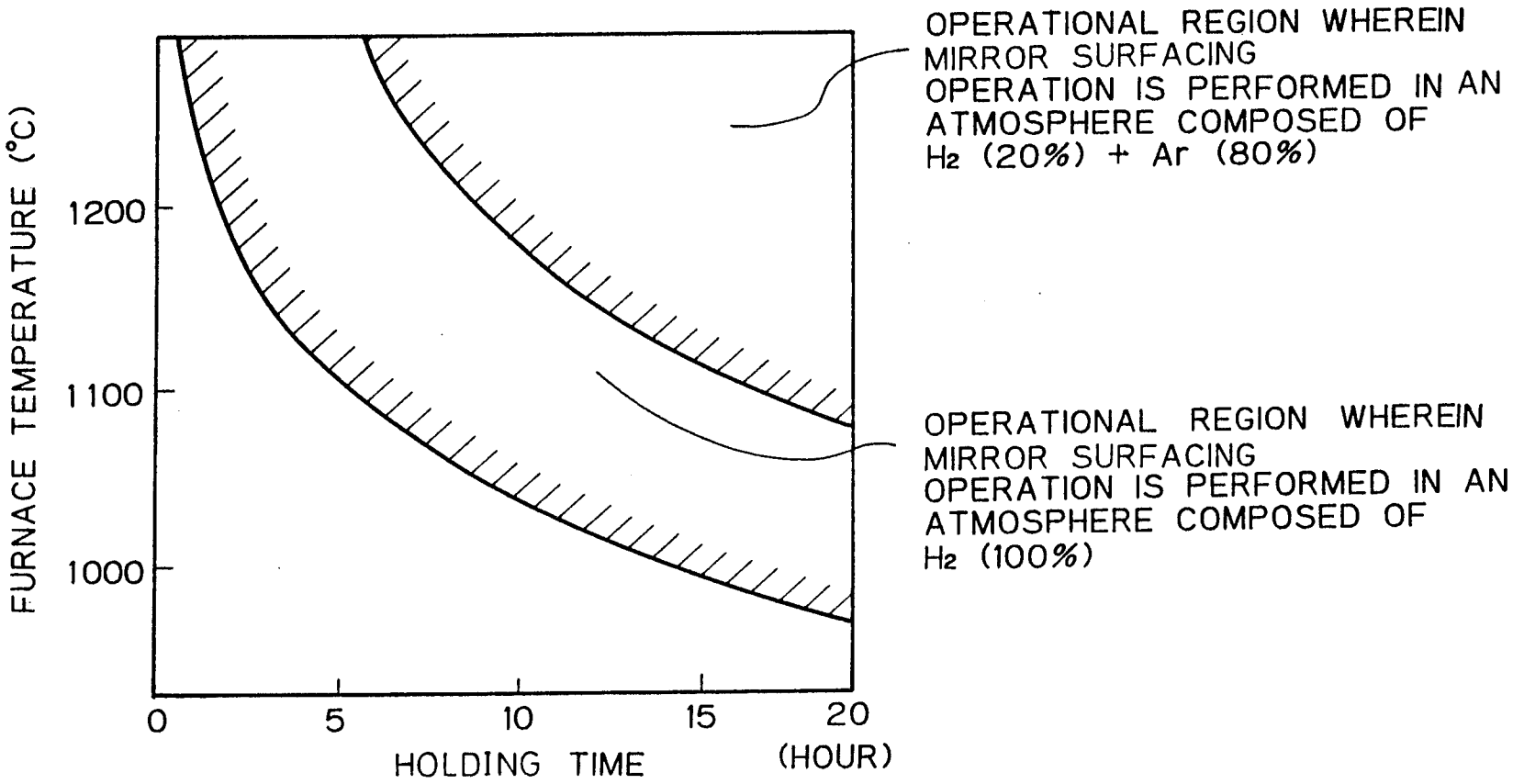
FIG. 2 is a diagram which illustrates a relationship between a time and a heat treatment temperature, with volumetric contents of a hydrogen gas and an argon gas used as a parameter, when surfaces of a grain oriented silicon steel sheet are subjected to a mirror surfacing treatment after a completion of a finish annealing operation.

FIG. 2 is a diagram which illustrates a relationship between a time and an annealing temperature for forming mirror surfaces on a silicon steel sheet in an atmosphere composed of a 100% hydrogen gas as well as an atmosphere composed of a mixture gas comprising 20% hydrogen gas and 80% argon gas, wherein the mirror surfaces have an average surface roughness of 0.3 micron or less and do not include any oxide film which may induce magnetic pinning.

Figure 3:
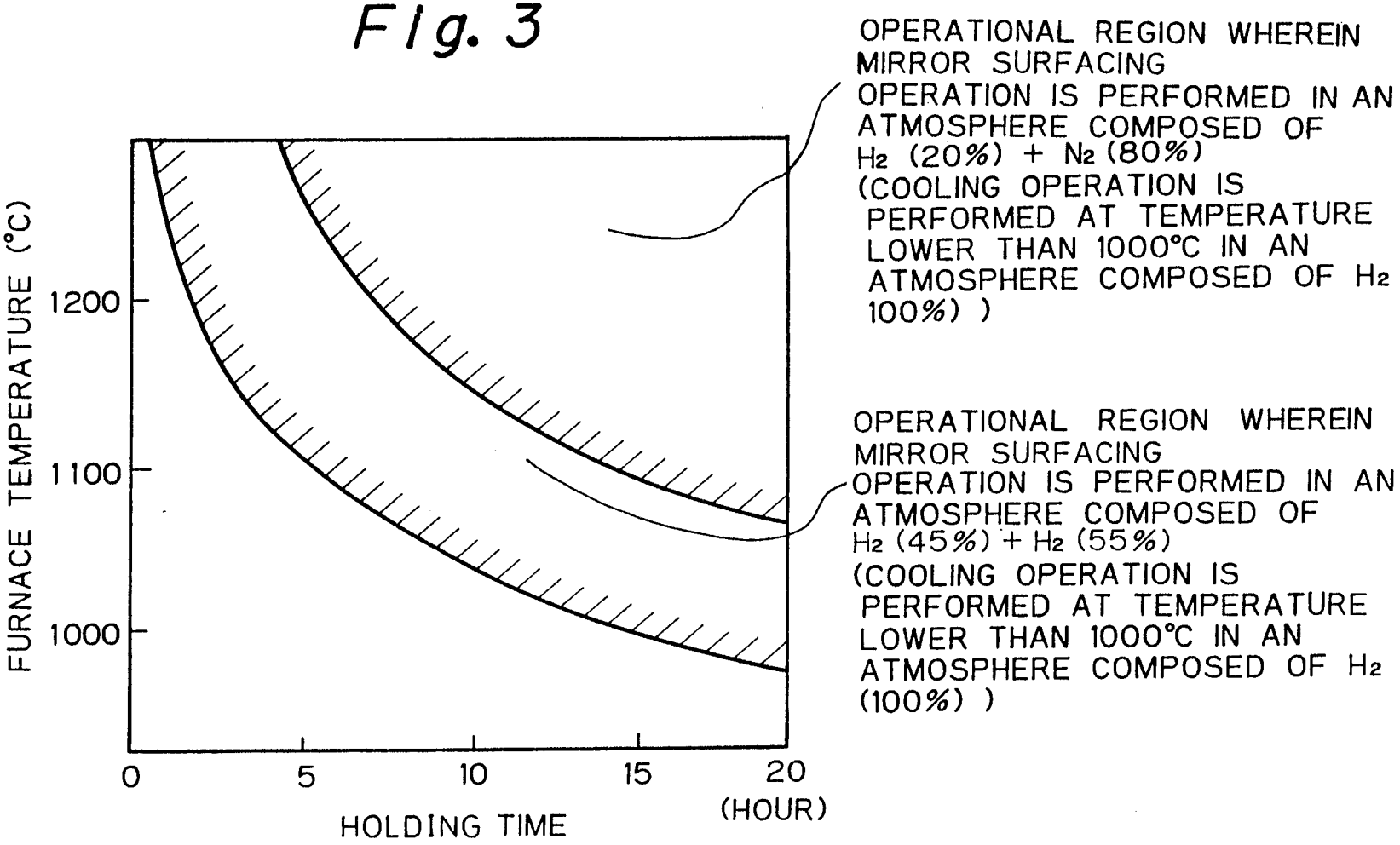
FIG. 3 is a diagram which illustrates a relationship between a time and a heat treatment temperature, with volumetric contents of a hydrogen gas and a nitrogen gas used as a parameter, when surfaces of a grain oriented silicon steel sheet are subjected to a mirror surfacing treatment after a completion of a finish annealing operation, wherein a cooling operation is performed at a temperature lower than 1000° C. in an atmosphere composed of a hydrogen gas of 100%.

FIG. 3 is a diagram which illustrates a relationship between a time and an annealing temperature for forming mirror surfaces on a silicon steel sheet in an atmosphere composed of a mixture gas comprising 45% hydrogen gas and 55% nitrogen gas, as well as an atmosphere composed of a mixture gas comprising 20% hydrogen gas and a 80% nitrogen gas, under the conditions that the silicon steel sheet is heated to an elevated temperature of 1000° C. or higher and a cooling of the silicon steel sheet is then performed at a temperature lower than 1000° C. in an atmosphere composed of 100% hydrogen gas, wherein the mirror surfaces have an average surface roughness of 0.3 micron or less and do not include any oxide film which may induce magnetic pinning.

When an annealing temperature is excessively high, a long time is needed to perform an annealing operation. For this reason, an annealing temperature as mentioned above is unacceptable from the viewpoint of an industrial process.

When each testpiece having mirror surfaces obtained in the above-described manner is coated with a coating liquid, for forming tensile stress additive films on surfaces of a silicon steel sheet, and the coated testpiece is then baked in an oven, it has been found that the same watt loss is obtained with the testpiece as that when a testpiece prepared by employing a chemical polishing process is coated with the foregoing coating liquid and the coated testpiece is then baked in an oven.

It should be noted that the present invention may be carried out in combination with a film forming treatment technique such as CVD, PVD, an iron plating process or the like.

The method of the present invention has an advantage in that a mirror surfacing operation can be easily and stably performed, compared with a conventional chemical polishing process or a conventional electrolytic polishing process. In addition, the method of the present invention has another advantage in that a reduction of the weight of a material used for forming mirror surfaces is very small, i.e., the weight reduction remains at a level of less than 1/10, compared with a weight reduction where each of the conventional processes is employed.

EXAMPLES

Example 1

After completion of a finish annealing operation, a grain oriented silicon steel sheet having a high magnetic flux density and a thickness of 0.23 mm, and containing a 3.2% by weight of silicon, was immersed in a mixed solution of sulfuric acid and fluoric acid to remove forsterite films on the silicon steel sheet. Thereafter, the silicon steel sheet was washed by water, and then the washed silicon steel sheet was dried. Subsequently, silicon steel sheets each treated in the above-described manner and silicon steel sheets each having forsterite films deposited thereon were alternately placed one on the other to form a laminated structure. Thereafter, an assembly of the silicon steel sheets laminated in the above-described manner was annealed at a temperature of 1200° C. for five hour's, in an atmosphere composed of 100% hydrogen gas. Subsequently, each silicon steel sheet was coated with a phosphoric acid based coating liquid, for forming tensile stress additive films on the silicon steel sheet, and the coated silicon steel sheet was then baked at a temperature of 830° C. for five minutes. The resultant silicon steel sheet product exhibited the watt loss values shown in Table 1.

TABLE 1

| | $B_5$ | $W_{17/50}$ |
|---|---|---|
| Conventional method (ferrous substrate + forsterite + tensile stress additive film) | 1.93 T | 0.87 W/kg |
| Method of the present invention (ferrous substrate + mirror surfacing + tensile stress additive film) | 1.94 T | 0.74 W/kg |

As apparent from the above table, according to the present invention, a watt loss property of the silicon steel sheet was remarkably improved (i.e., each value indicating of a watt loss was substantially reduced), compared with the conventional method.

Example 2

After completion of the finish annealing, forsterite films on surfaces of a grain oriented silicon steel sheet having a high magnetic flux density and a thickness of 0.23 and containing 3.2% of silicon by weight were manually removed therefrom by rubbing with an emery paper No. 150. Thereafter, the silicon steel sheet was coated with a coating liquid containing aluminum powder suspended in a methyl alcohol when stirred, and the coated silicon steel sheets were then placed one on the other to form a laminated structure. Subsequently, an assembly of the silicon steel sheets laminated in the above-described manner was annealed at a temperature of 1100° C. for 20 hours in an atmosphere composed of a mixture gas comprising 55% hydrogen gas and 45% nitrogen gas.

Subsequently, each silicon steel sheet treated in the above-described manner was coated with a phosphoric acid based coating liquid, to form tensile stress additive films on the silicon steel sheet, and the coated silicon steel sheet was then baked at a temperature of 830° C. for three minutes. The resultant silicon steel sheet product exhibited the watt loss values shown in Table 2.

TABLE 2

| | $B_5$ | $W_{17/50}$ |
|---|---|---|
| Conventional method (ferrous substrate + forsterite + tensile stress additive film) | 1.94 T | 0.86 W/kg |
| Method of the present invention (ferrous substrate + mirror surfacing + tensile stress additive film) | 1.95 T | 0.76 W/kg |

As apparent from the above table, according to the present invention, a watt loss property of the silicon steel sheet was remarkably improved (i.e., each value indicating a watt loss was substantially reduced), compared with the conventional method.

Example 3

After completion of the finish annealing a grain oriented silicon steel sheet having a high magnetic flux density and a thickness of 0.30 mm, and containing a 3.3% by weight of silicon, was immersed in a solution composed of sulfuric acid and fluoric acid in the mixed state, to remove forsterite films therefrom. Thereafter, the silicon steel sheet was washed by water, and the washed silicon steel sheet then dried. Subsequently, each silicon steel sheet was coated with a coating liquid containing magnesia suspended in an ethyl alcohol when stirred, and the coated silicon steel sheets were then placed one on the other to form a laminated structure.

An assembly of the silicon steel sheets laminated in the above-described manner was annealed at a temperature of 1000° C. for 30 hours in an atmosphere composed of a mixture gas comprising 75% hydrogen gas and 25% nitrogen gas. Subsequently, each silicon steel sheet treated in the above-described manner was coated with a phosphoric based coating liquid, to form tensile stress additive films on the silicon steel sheet, and the coated silicon steel sheet was baked at a temperature of 840° C. for four minutes. The resultant silicon steel sheet exhibited the watt loss values shown in Table 3.

TABLE 3

| | $B_5$ | $W_{17/50}$ |
|---|---|---|
| Conventional method (ferrous substrate + forsterite + tensile stress additive film) | 1.94 T | 1.02 W/kg |
| Method of the present invention (ferrous substrate + mirror surfacing + tensile stress additive film) | 1.94 T | 0.87 W/kg |

As apparent from the above table, according to the present invention, a watt loss property of the silicon steel sheet was remarkably improved (i.e., each value indicating a watt loss was substantially reduced), compared with the conventional method.

Example 4

After completion of the finish annealing, a grain oriented silicon steel sheet having a high magnetic flux density and a thickness of 0.23 mm, and containing a 3.2% by weight of silicon was immersed in a solution composed of sulfuric acid and fluoric acid in the mixed state, to remove forsterite films therefrom. Thereafter, the silicon steel sheet was washed by water and the washed silicon steel sheet was then dried. Subsequently, silicon steel sheets each treated in the above-described manner, and silicon steel sheets each having forsterite films still deposited thereon, were alternately placed one on the other to form a laminated structure. Thereafter, an assembly of the silicon steel sheets laminated in the above-described manner was annealed at a temperature of 1200° C. for eight hours in an atmosphere composed of 20% hydrogen gas and 80% argon gas. Subsequently, each silicon steel sheet treated in the above-described manner was coated with a phosphoric acid based coating liquid, to form tensile stress additive films on the silicon steel sheet, and the coated silicon steel sheet then baked at a temperature of 830° C. for five minutes. The resultant silicon steel sheet exhibited the watt loss values shown in Table 4.

TABLE 4

| | $B_5$ | $W_{17/50}$ |
|---|---|---|
| Conventional method (ferrous substrate + forsterite + tensile stress additive film) | 1.92 T | 0.86 W/kg |
| Method of the present invention (ferrous substrate + mirror surfacing + tensile stress additive film) | 1.94 T | 0.73 W/kg |

As apparent from the above table, according to the present invention, a watt loss property of the silicon steel sheet was remarkably improved (i.e., each value indicating a watt loss was substantially reduced), compared with the conventional method.

Example 5

After completion of a finish annealing, forsterite films on surfaces of a grain oriented silicon steel sheet having a high magnetic flux density and a thickness of 0.23 mm, and containing a 3.2% by weight of silicon were manually removed by rubbing with an emery paper No. 150. Thereafter, the silicon steel sheet was coated with a coating liquid containing aluminum powder suspended in a methyl alcohol when stirred, and the coated silicon steel sheets were then placed one on the other to form a laminated structure. Subsequently, an assembly of the silicon steel sheets laminated in the above-described manner was annealed at a temperature of 1100° C. for 20 hours in an atmosphere composed of a mixture gas comprising 40% hydrogen gas and 60% argon gas.

Subsequently, each silicon steel sheet treated in the above-described manner was coated with a phosphoric acid based coating liquid, to form tensile stress additive films on the silicon steel sheet, and the coated silicon steel sheet then baked at a temperature of 830° C. for three minutes. The resultant silicon steel sheet exhibited the watt loss values shown in Table 5.

TABLE 5

| | $B_s$ | $W_{17/50}$ |
|---|---|---|
| Conventional method (ferrous substrate + forsterite + tensile stress additive film) | 1.94 T | 0.86 W/kg |
| Method of the present invention (ferrous substrate + mirror surfacing + tensile stress additive film) | 1.95 T | 0.77 W/kg |

As apparent from the above table, according to the present invention, a watt loss property of the silicon steel sheet was remarkably improved (i.e., each value indicating a watt loss was substantially reduced), compared with the conventional method.

Example 6

After completion of a finish annealing, a grain oriented silicon steel sheet having a high magnetic flux density and a thickness of 0.30 mm, and containing a 3.3% by weight of silicon, was immersed in a solution composed of sulfuric acid and fluoric acid in the mixed state, to remove forsterite films therefrom. Thereafter, the silicon steel sheet was washed by water and the washed silicon steel sheet then dried. Subsequently, each silicon steel sheet was coated with a coating liquid containing magnesia suspended in an ethyl alcohol when stirred and the coated silicon steel sheets were then placed one on the other to form a laminated structure.

An assembly of the silicon steel sheets laminated in the above-described manner was annealed at a temperature of 1000° C. for 30 hours in an atmosphere composed of a mixture gas comprising 60% hydrogen gas and 40% argon gas. Subsequently, each silicon steel sheet treated in the above-described manner was coated with a phosphoric acid based coating liquid, to form tensile stress additive films on the silicon steel sheet, and the coated silicon steel sheet then baked at a temperature of 840° C. for four minutes. The resultant silicon steel sheet exhibited the watt loss values shown in Table 6.

TABLE 6

| | $B_s$ | $W_{17/50}$ |
|---|---|---|
| Conventional method (ferrous substrate + forsterite + tensile stress additive film) | 1.93 T | 1.01 W/kg |
| Method of the present invention (ferrous substrate + mirror surfacing + tensile stress additive film) | 1.93 T | 0.86 W/kg |

As apparent from the above table, according to the present invention, a watt loss property of the silicon steel sheet was remarkably improved (i.e., each value indicating a watt loss was substantially reduced), compared with the conventional method.

Example 7

After completion of the annealing, a grain oriented silicon steel sheet having a high magnetic flux density and a thickness of 0.23 mm, and containing 3.2% by weight of silicon, was immersed in a solution composed of sulfuric acid and fluoric acid in the mixed state, to remove forsterite films therefrom. Thereafter, the silicon steel sheet was washed by water and the washed silicon steel sheet then dried. Subsequently, silicon steel sheets each treated in the above-described manner and silicon steel sheets, and each having forsterite films deposited thereon, were alternately placed one on the other to form a laminated structure. Thereafter, an assembly of the silicon steel sheets laminated in the above-described manner was annealed at a temperature of 1200° C. for eight hours in an atmosphere composed of 25% hydrogen gas and 75% nitrogen gas. After completion of the annealing, cooling was started at a temperature lower than 1000° C., to cool the silicon steel sheets to room temperature under the condition that an atmosphere composed of 100% hydrogen gas was substituted for the foregoing atmosphere. Subsequently, each silicon steel sheet treated in the above-described manner was coated with a phosphoric acid based coating liquid, to form tensile stress additive films on the silicon steel sheet, and the coated silicon steel sheet then baked treatment at a temperature of 830° C. for five minutes. The resultant silicon steel sheet exhibited the watt loss values shown in Table 7.

TABLE 7

| | $B_s$ | $W_{17/50}$ |
|---|---|---|
| Conventional method (ferrous substrate + forsterite + tensile stress additive film) | 1.93 T | 0.87 W/kg |
| Method of the present invention (ferrous substrate + mirror surfacing + tensile stress additive film) | 1.93 T | 0.76 W/kg |

As apparent from the above table, according to the present invention, a watt loss property of the silicon steel sheet was remarkably improved (i.e., each value indicating a watt loss was substantially reduced), compared with the conventional method.

Example 8

After completion of a finish annealing, forsterite films on surfaces of a grain oriented silicon steel sheet having a high magnetic flux density and a thickness of 0.23 mm, and containing 3.2% by weight of silicon were manually removed therefrom by rubbing with an emery paper No. 150. Thereafter, the silicon steel sheet was coated with a coating liquid containing alumina power suspended in a methyl alcohol when stirred, and the coated silicon steel sheets were then placed one on the other to form a laminated structure. Subsequently, an assembly of the silicon steel sheets laminated in the above-described manner was annealed at a temperature of 1100° C. for 20 hours in an atmosphere composed of a mixture gas comprising 40% hydrogen gas and 60% nitrogen gas. After completion of the annealing, cooling was started at a temperature lower than 1000° C., to cool the silicon steel sheets to room temperature under the condition that an atmosphere composed of 100% hydrogen gas was substituted for the foregoing atmosphere.

Subsequently, each silicon steel sheet treated in the above-described manner was coated with a phosphoric acid based coating liquid, to form tensile stress additive films on the silicon steel sheet, and the coated silicon steel sheet then baked at a temperature of 830° C. for three minutes. The resultant silicon steel sheet exhibited the watt loss values shown in Table 8.

TABLE 8

| | $B_5$ | $W_{17/50}$ |
|---|---|---|
| Conventional method (ferrous substrate + forsterite + tensile stress additive film) | 1.94 T | 0.86 W/kg |
| Method of the present invention (ferrous substrate + mirror surfacing + tensile stress additive film) | 1.94 T | 0.75 W/kg |

As apparent from the above table, according to the present invention, a watt loss property of the silicon steel sheet was remarkably improved (i.e., each value indicating a watt loss was substantially reduced), compared with the conventional method.

Example 9

After completion of a finish annealing, a grain oriented silicon steel sheet having a high magnetic flux density and a thickness of 0.30 mm, and containing a 3.3% by weight of silicon, was immersed in a solution composed of sulfuric acid and fluoric acid in the mixed state, to remove forsterite films therefrom. Thereafter, the silicon steel sheet was washed by water and the washed silicon steel sheet then dried. Subsequently, each silicon steel sheet was coated with a coating liquid containing magnesia powder suspended in an ethyl alcohol when stirred, and the coated silicon steel sheets were then placed one on the other to form a laminated structure.

An assembly of the silicon steel sheets laminated in the above-described manner was annealed at a temperature of 1000° C. for 30 hours in an atmosphere composed of a mixture gas comprising 45% hydrogen gas and 55% nitrogen gas. After completion of the annealing, cooling was started at a temperature lower than 1000° C., to cool the silicon steel sheets to room temperature, under the condition that an atmosphere composed of 100% hydrogen gas was substituted for the foregoing atmosphere. Subsequently, each silicon steel sheet treated in the above-described manner was coated with a phosphoric acid based coating liquid, to form tensile stress additive films on the silicon steel sheet, and the coated silicon steel sheet then baked at a temperature of 840° C. for four minutes. The resultant silicon steel sheet exhibited the watt loss values shown in Table 9.

TABLE 9

| | $B_5$ | $W_{17/50}$ |
|---|---|---|
| Conventional method (ferrous substrate + forsterite + tensile stress additive film) | 1.93 T | 1.03 W/kg |
| Method of the present invention (ferrous substrate + mirror surfacing + tensile stress additive film) | 1.95 T | 0.84 W/kg |

As apparent from the above table, according to the present invention, a watt loss property of the silicon steel sheet was remarkably improved (i.e., each value indicating a watt loss was substantially reduced), compared with the conventional method).

Example 10

After completion of a finish annealing, forsterite films on surfaces of a grain oriented silicon steel sheet having a high magnetic flux density and a thickness of 0.32 mm, and containing 3.2% by weight of silicon were manually removed therefrom by rubbing with an emery paper No. 150. Thereafter, the silicon steel sheet was coated with a coating liquid containing alumina powder suspended in a methyl alcohol when stirred, and the coated silicon steel sheets were then placed one on the other to form a laminated structure. Subsequently, an assembly of the silicon steel sheets laminated in the above-described manner was annealed at a temperature of 1100° C. for 20 hours in an atmosphere composed of a mixture gas comprising 50% hydrogen gas and 50% nitrogen gas.

Subsequently, each silicon steel sheet treated in the above-described manner was coated with a phosphoric acid based coating liquid, to form tensile stress additive films on the silicon steel sheet, and the coated silicon steel sheet then baked at a temperature of 830° C. for three minutes. The resultant silicon steel sheet exhibited the watt loss values shown in Table 10.

TABLE 10

| | $B_5$ | $W_{17/50}$ |
|---|---|---|
| Conventional method (ferrous substrate + forsterite + tensile stress additive film) | 1.94 T | 0.86 W/kg |
| Method of the present invention (ferrous substrate + mirror surfacing + tensile stress additive film) | 1.95 T | 0.76 W/kg |

As apparent from the above table, according to the present invention, a watt loss property of the silicon steel sheet was remarkably improved (i.e., each value indicating a watt loss was substantially reduced), compared with the conventional method.

Example 11

After completion of a finish annealing, a grain oriented silicon steel sheet having a high magnetic flux density and a thickness of 0.30 mm, and containing a 3.3% by weight of silicon, was immersed in a solution composed of sulfuric acid and fluoric acid in the mixed state, to remove forsterite films therefrom. Thereafter, the silicon steel sheet was washed by water and the washed silicon steel sheet then dried. Subsequently, each silicon steel sheet was coated with a coating liquid containing magnesia powder suspended in an ethyl alcohol when stirred, and the coated silicon steel sheets were then placed one on the other to form a laminated structure.

An assembly of the silicon steel sheets laminated in the above-described manner was annealed at a temperature of 1000° C. for 30 hours in an atmosphere composed of a mixture gas comprising 75% hydrogen gas and 25% argon gas. Subsequently, each silicon steel sheet treated in the above-described manner was coated with a phosphoric acid based coating liquid, to form tensile stress additive films, and the coated silicon steel sheet then baked at a temperature of 840° C. for four minutes. The resultant silicon steel sheet exhibited the watt loss values shown in Table 11.

TABLE 11

| | $B_5$ | $W_{17/50}$ |
|---|---|---|
| Conventional method (ferrous substrate + forsterite + tensile stress additive film) | 1.94 T | 1.02 W/kg |
| Method of the present invention (ferrous substrate + mirror surfacing + tensile stress additive film) | 1.94 T | 0.85 W/kg |

As apparent from the above table, according to the present invention, a watt loss property of the silicon steel sheet was remarkably improved (i.e., each value indicating a watt loss was substantially reduced), compared with the conventional method.

Example 12

After completion of a finish annealing, a grain oriented silicon steel sheet having a high magnetic flux density and a thickness of 0.23 mm, and containing a 3.2% by weight of silicon, was immersed in a solution composed of sulfuric acid and fluoric acid, to remove forsterite films therefrom. Thereafter, the silicon steel sheet was washed by water and the washed silicon steel sheet then dried. Subsequently, silicon steel sheets each treated in the above-described manner and silicon steel sheets each having forsterite films deposited thereon were alternately placed one on the other to form a laminated structure. Thereafter, an assembly of the silicon steel sheets laminated in the above-described manner was annealed at a temperature of 1200° C. for five hours in an atmosphere composed of a mixture gas comprising 30% hydrogen gas, 50% carbon monoxide gas, and 20% nitrogen gas. Subsequently, each silicon steel sheet was coated with phosphoric acid based coating liquid, to form tensile stress additive films on the silicon steel sheet, and the coated silicon steel sheet then baked at a temperature of 830° C. for five minutes. The resultant silicon steel sheet exhibited the watt loss value shown in Table 12.

TABLE 12

| | $B_5$ | $W_{17/50}$ |
|---|---|---|
| Conventional method (ferrous substrate + forsterite + tensile stress additive film) | 1.94 T | 0.88 W/kg |
| Method of the present invention (ferrous substrate + mirror surfacing + tensile stress additive film) | 1.94 T | 0.77 W/kg |

As apparent from the above table, according to the present invention, a watt loss property of the silicon steel sheet was remarkably improved (i.e., each value indicating a watt loss was substantially reduced), compared with the conventional method.

Example 13

After completion of a finish annealing, forsterite films on surfaces of a grain oriented silicon steel sheet having a high magnetic flux density and a thickness of 0.23 mm, and containing 3.2% weight of silicon were manually removed therefrom by rubbing with an emery paper No. 150. Thereafter, the silicon steel sheet was coated with a coating liquid containing alumina powder suspended in a methyl alcohol when stirred, and the coated silicon steel sheets were then placed one on the other to form a laminated structure. An assembly of the silicon steel sheets laminated in the above-described manner was annealed at a temperature of 1100° C. for 20 hours in an atmosphere composed of a mixture gas comprising 30% hydrogen gas, 30% carbon monoxide gas and 40% nitrogen gas.

Subsequently, each silicon steel sheet treated in the above-described manner was coated with a phosphoric acid based coating liquid, to form tensile stress additive films on the silicon steel sheet, and the coated silicon steel sheet then baked at a temperature of 830° C. for three minutes. The resultant silicon steel sheet exhibited the watt loss values as shown in Table 13.

TABLE 13

| | $B_5$ | $W_{17/50}$ |
|---|---|---|
| Conventional method (ferrous substrate + forsterite + tensile stress additive film) | 1.93 T | 0.89 W/kg |
| Method of the present invention (ferrous substrate + mirror surfacing + tensile stress additive film) | 1.94 T | 0.78 W/kg |

As apparent from the above table, according to the present invention, a watt loss property of the silicon steel sheet was remarkably improved (i.e., each value indicating a watt loss was substantially reduced), compared with the conventional method.

Example 14

After completion of a finish annealing operation, a grain oriented silicon steel sheet having a high magnetic flux density and a thickness of 0.3 mm, and containing a 3.3% by weight of silicon, was immersed in a solution composed of a sulfuric acid and a fluoric acid in the mixed state, to remove forsterite films therefrom. Thereafter, the silicon steel sheet was washed by water and the washed silicon steel sheet then dried. The silicon steel sheets each treated in the above-described manner were placed one on the other to form a laminated structure.

Subsequently, an assembly of the silicon steel sheets laminated in the above-described manner was annealed at a temperature of 1000° C. for 30 hours in an atmosphere composed of a mixture gas comprising 40% hydrogen gas, 35% carbon monoxide gas, and 25% argon gas. Thereafter, each silicon steel sheet was coated with a coating liquid, to form tensile stress additive films on the silicon steel sheet, and the coated silicon steel sheet then baked at a temperature of 840° C. for four minutes. The resultant silicon steel sheet exhibited the watt loss values shown in Table 14.

TABLE 14

| | $B_5$ | $W_{17/50}$ |
|---|---|---|
| Conventional method (ferrous substrate + forsterite + tensile stress additive film) | 1.94 T | 1.04 W/kg |
| Method of the present invention (ferrous substrate + mirror surfacing + tensile stress additive film) | 1.94 T | 0.88 W/kg |

As apparent from the above table, according to the present invention, a watt loss property of the silicon steel sheet was remarkably improved (i.,e., each value indicating a watt loss was substantially reduced), compared with the conventional method.

Although the present invention has been described above with respect to a single preferred embodiment and fourteen examples, it should of course be understood that the present invention is not limited only to this embodiment and that various changes or modifications may be made without departing from the scope of the invention as defined by the appended claims.

We claim:

1. In a method of producing grain oriented silicon steel sheets or strips each having a low watt loss, the improvement comprising:

a step of removing an oxide layer on surfaces of each grain oriented silicon steel sheet or strip after completion of a finish annealing, to allow surfaces of a ferrous substrate of said silicon steel sheet or strip to be exposed to the outside, a step of annealing said silicon steel sheet or strip within the temperature range of 1000° C. or higher in an atmosphere composed of a mixture gas comprising 20 to 100% by volume of hydrogen gas and 0 to 80% by volume of an inert gas to allow said surfaces of said ferrous substrate to be given a mirror surface, and a step of forming a tensile stress additive film on each of said surfaces of said ferrous substrate.

2. The method as claimed in claim 1, wherein said step of annealing said silicon steel sheet or strip is carried out in an atmosphere composed of a mixture gas comprising a 50 to 100% by volume of hydrogen gas and 0 to 50% by volume of an inert gas.

3. The method as claimed in claim 1, wherein said inert gas is an argon gas.

4. The method as claimed in claim 1 or claim 2, wherein said inert gas is a nitrogen gas.

5. The method as claimed in claim 1, wherein said step of annealing said silicon steel sheet or strip is carried out in an atmosphere composed of a mixture gas comprising a hydrogen gas and a carbon monoxide gas at 50 to 100% by volume, and an inert gas at 0 to 50% by volume.

6. The method as claimed in claim 5, wherein said inert gas is an argon gas.

7. The method as claimed in claim 5, wherein said inert gas is a nitrogen gas.

8. The method as claimed in claim 1, wherein said step of annealing said silicon steel sheet or strip is carried out in an atmosphere composed of a mixture gas comprising a 20 to 50% by volume of hydrogen gas and 50 to 80% by volume of nitrogen gas, and thereafter, said silicon steel sheet or strip is cooled in a temperature range lower than 1000° C. in an atmosphere composed of 100% hydrogen gas.

9. The method as claimed in claim 1, wherein said step of annealing said silicon steel sheet or strip is carried out after one or both of alumina powder and magnesia powder are spread over an intermediate region between adjacent silicon steel sheets or strips which have completed said step of removing an oxide layer or another silicon steel sheet or strips having forsterite films deposited thereon is interposed between said adjacent silicon steel sheets or strips.

10. The method as claimed in claim 8, wherein said step of annealing said silicon steel sheet or strip is carried out after one or both of alumina powder and magnesia powder are spread over an intermediate region between adjacent silicon steel sheets or strips which have completed said step of removing an oxide layer or another silicon steel sheet or strips having forsterite films deposited thereon is interposed between said adjacent silicon steel sheets or strips.

11. The method as claimed in claim 1, wherein means for allowing surfaces of a ferrous substrate of each silicon steel sheet or strip to be exposed to the outside is employed for practicing the method, said means comprising a chemical polishing process or a mechanical polishing process.

* * * * *